US005147764A

United States Patent [19]

Bowne

[11] Patent Number: 5,147,764

[45] Date of Patent: Sep. 15, 1992

[54] PHOTOGRAPHIC ELEMENT WITH 2-EQUIVALENT 5-PYRAZOLONE AND COMPETITOR FOR OXIDIZED DEVELOPING AGENT

[75] Inventor: Arlyce T. Bowne, Rochester, N.Y.

[73] Assignee: Eastman Kodak Company, Rochester, N.Y.

[21] Appl. No.: 696,313

[22] Filed: Apr. 30, 1991

Related U.S. Application Data

[63] Continuation of Ser. No. 545,172, Jun. 28, 1990, abandoned.

[51] Int. Cl.[5] ..... G03C 7/38; G03C 5/50

[52] U.S. Cl. ..... 430/372; 430/379; 430/380; 430/546; 430/548; 430/551; 430/555

[58] Field of Search ..... 430/379, 380, 214, 547, 430/551, 359, 548, 372, 546

[56] References Cited

U.S. PATENT DOCUMENTS

| | | | |
|---|---|---|---|
| 3,141,771 | 7/1964 | Bard et al. | 430/214 |
| 3,384,484 | 5/1968 | Schranz et al. | 430/551 |
| 3,933,493 | 1/1976 | Ohyama et al. | 430/214 |
| 4,650,746 | 3/1987 | Simson et al. | 430/438 |
| 4,684,604 | 8/1987 | Harder | 430/559 |
| 4,923,787 | 5/1990 | Harder | 430/489 |
| 4,933,265 | 6/1990 | Inoue et al. | 430/547 |
| 4,985,351 | 1/1991 | Matejec et al. | 430/598 |

FOREIGN PATENT DOCUMENTS

| | | |
|---|---|---|
| 0326406 | 8/1989 | European Pat. Off. . |
| 0338785 | 10/1989 | European Pat. Off. . |

OTHER PUBLICATIONS

Patent Abs. of Japan, vol. 11, No. 297 (P-592)(2654) Jul. 1987.

*Primary Examiner*—Richard L. Schilling
*Attorney, Agent, or Firm*—Joshua G. Levitt

[57] ABSTRACT

Photographic elements are described having
a silver halide emulsion layer,
a 2-equivalent 5-pyrazolone coupler is reactive association with said silver halide emulsion, and
a competitor for oxidized developer in reactive association with said coupler having the formula:

wherein
$R^1$ represents an electron donating group,
$R^2$ represents hydrogen, alkyl, alkoxy, aryl, aryloxy, aralkyl or amino of the formula —$NHR^3$, where $R^3$ is phenyl or benzyl, with the proviso that at least one ofthe substitutents $R^1$ and $R^2$ (a) represents (1) a ballast group of sufficient size as to render the hydrazide compound non-diffusible in the photographic element prior to development in alkaline processing solution and (b) comprises a polar group, and
n is 0, 1 or 2.

22 Claims, No Drawings

PHOTOGRAPHIC ELEMENT WITH 2-EQUIVALENT 5-PYRAZOLONE AND COMPETITOR FOR OXIDIZED DEVELOPING AGENT

This is a continuation of application Ser. No. 545,172, filed Jun. 28, 1990, now abandoned.

FIELD OF THE INVENTION

This invention relates to photography, and specifically to color photographic materials containing 2-equivalent 5-pyrazolone couplers and hydrazide oxidized color developer competitors.

BACKGROUND OF THE INVENTION

Color silver halide photographic materials rely on coupler compounds to form dyes that make up the image recorded in such materials. Usually a yellow dye-forming coupler will be associated with a blue-sensitive silver halide emulsion layer, a magenta dye-forming coupler will be associated with a green-sensitive silver halide emulsion layer, and a cyan dye-forming coupler will be associated with a red-sensitive silver halide emulsion layer. With color negative materials, the material is exposed to light and processed with a color developer that imagewise forms a silver image and a dye image. The silver image is bleached and solubilized for removal, leaving only a negative color dye image. This image is then used to expose another color negative material to form a positive color dye image. With one common type of color reversal material, the material is exposed and processed with a black-and-white developer to form a negative silver image in each layer. The silver is then bleached and solubilized for removal, leaving a positive imagewise pattern of unexposed silver halide. The material is then chemically fogged and processed in a color developer to form a positive silver and dye image. The silver is then bleached and solubilized for removal, leaving only the positive color dye image.

There are many known classes of compounds that are useful as couplers in photographic materials. 5-Pyrazolone coupler compounds are well-known as magenta dye-forming couplers. Such couplers are described in, for example, James, *The Theory of the Photographic Process*, MacMillan, 1977.

While 5-pyrazolone compounds are useful dye-forming couplers, photographic materials and compositions utilizing them often do not provide as high a contrast as might be desired. It is thus an object of this invention to provide higher contrast for photographic compositions containing 5-pyrazolone coupler compounds.

SUMMARY OF THE INVENTION

According to the present invention, a photographic element contains a silver halide emulsion layer, a 2-equivalent 5-pyrazolone coupler in reactive association with said silver halide emulsion, and a competitor for oxidized developer in reactive association with said coupler having the formula:

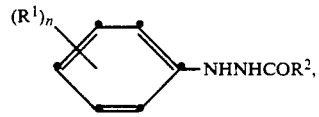

(I)

wherein $R^1$ represents an electron donating group, $R^2$ represents hydrogen, alkyl, alkoxy, aryl, aryloxy, aralkyl or amino of the formula —NHR$^3$, where $R^3$ is phenyl or benzyl, with the proviso that at least one of the substituents $R^1$ and $R^2$ (a) represents (1) a ballast group of sufficient size as to render the hydrazide compound non-diffusible in the photographic element prior to development in alkaline processing solution and (b) comprises a polar group, and n is 0, 1 or 2.

The photographic element of the invention provides magenta dye images in response to exposure with radiation. The element's response to exposure exhibits increased contrast compared to prior art 2-equivalent 5-pyrazolone coupler-containing photographic elements. Additionally, improvements in D-max are observed with 2-equivalent 5-pyrazolone couplers.

DESCRIPTION OF THE PREFERRED EMBODIMENTS

According to formula (I), $R^1$ substituents, which are electron donating groups, include alkyl, which can be substituted or unsubstituted, straight or branched chain, having from 1 to about 20 carbon atoms, preferably from about 8 to about 16 carbon atoms; alkoxy, which can be substituted or an unsubstituted, straight or branched chain, having from 1 to about 20 carbon atoms, preferably from about 8 to about 16 carbon atoms; carboxy, carbonamido having the formula —NR$^4$COR$^5$; sulfonamido having the —NR$^4$SO$_2$R$^5$; or amino having the formula —NR$^4$R$^5$ where $R^4$ is hydrogen or alkyl having from 1 to about 8 carbon atoms and $R^5$ is as defined for $R^4$ or is a benzyl or a phenyl group which may be substituted.

$R^2$ substituents that are alkyl or alkoxy can be as defined for these same substituents in $R^1$, or $R^2$ can be substituted or unsubstituted aryl or substituted or unsubstituted aryloxy having from 6 to about 30 carbon atoms, such as phenyl, phenoxy, naphthyl or naphthoxy.

When $R^2$ represents phenyl or phenoxy it is preferred that the aryl ring have a hydrogen bonding substituent in a position ortho to the point of attachment of the carbonyl group to a hydrazide nitrogen atom. Preferred hydrogen bonding groups include hydroxy, primary or secondary amino groups of the formula —NR$^4$R$^5$, sulfonamido of the formula —NHSO$_2$R$^4$, carbonamido of the formula —NR$^4$COR$^5$ and ureido of the formula —NHCONHR$^4$ where $R^4$ and $R^5$ can be hydrogen or alkyl of from 1 to about 8 carbon atoms and $R^5$ is as defined for $R^4$ or a benzyl or phenyl group.

These groups can also be present as substituents on $R^2$ alkyl groups or on other positions of $R^2$ aryl groups.

A polar group which can represent $R^1$ or $R^2$ can be a single group or a combination of groups which have a $\pi$ constant which is more negative than $-1.0$. The $\pi$ constant is defined by C. Hansch, A. Leo, S. Unger, K. Hwan Kim, D. Nikaitani and E. T. Lien, in *JOURNAL*

*OF ORGANIC CHEMISTRY*, 11, 1973 (pp. 1207-1216). The $R^1$ or $R^2$ polar group or groups include, but are not limited to, $—NHSO_2CH_3$, $—NHSO_2aryl$,

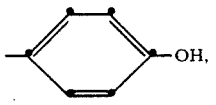

$—CH_2OH$, $—NH_2$, $—COOH$, $—CONH_2$, $—NHCONH_2$, $—NHCSNH_2$, $—N^+(R^5)_3$, $—SO_3^-$, $—SO_2^-$ and

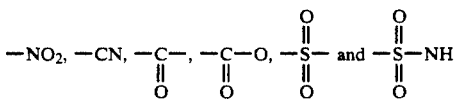

These groups tend to increase the surfactant nature of the hydrazine during alkaline processing.

The alkyl, alkoxy, aryl, aryloxy, aralkyl and benzyl groups which are represented by one or more of $R^1$, $R^2$, $R^3$, $R^4$ and $R^5$ can be substituted with halogen atoms, for example chlorine, or with haloalkyl groups, for example trifluoromethyl, or with

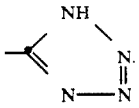

Typical compounds which fall within the above-presented structural formula include:

(I-1)

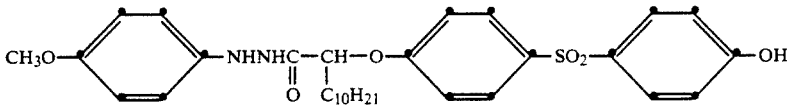

(I-2)

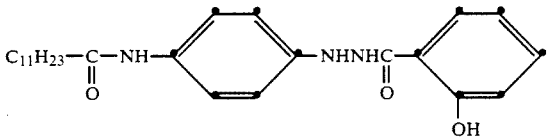

(I-3)

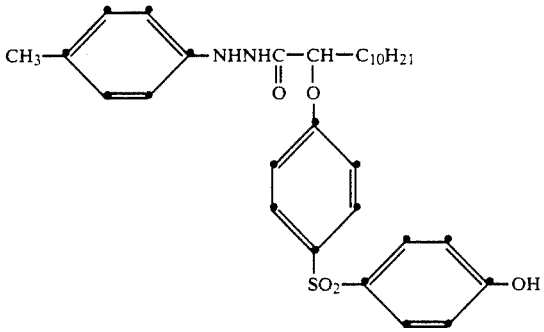

(I-4)

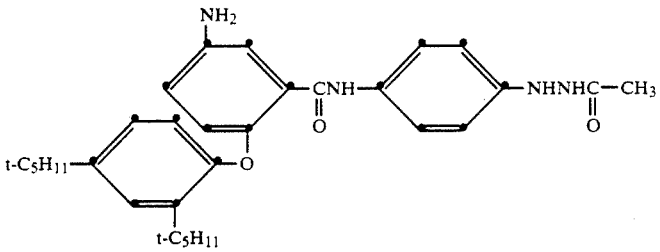

(I-5)

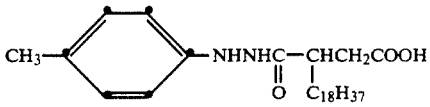

(I-6)

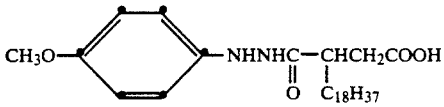

Other compounds according to formula (I), and methods of their synthesis, are described in U.S. application Ser. No. 07/351,515, now U.S. Pat. No. 4,923,787, the disclosure of which is incorporated herein by reference.

2-Equivalent 5-pyrazolone couplers as a class are well-known to one skilled in the art. The couplers may be polymeric or non-polymeric. Non-polymeric 2-equivalent 5-pyrazolone couplers useful in the practice of the invention include those according to the formula:

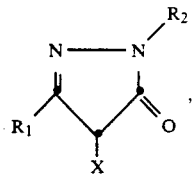

(II)

$R_1$ represents a carbonamido group, a ureido group, a sulfonamido group, an alkylamino group, an arylamino (preferably anilino) group, or a heterocyclic amino group, $R_2$ represents an aryl group, such as a substituted or unsubstituted phenyl group, and X represents a group capable of being released by a coupling reaction with an oxidized aromatic primary amine developing agent. This group is hereinafter referred to as a coupling-off group. Coupling-off groups are known in the art and may include a group containing an aliphatic group, an aromatic group, a heterocyclic group, an aliphatic, aromatic, or heterocyclic sulfonyl group, or an aliphatic, aromatic, or heterocyclic carbonyl group that is bonded to the coupling active carbon via an oxygen atom, a nitrogen atom, a sulfur atom, or a carbon atom, a halogen atom, an aromatic azo group, and the like. The aliphatic, aromatic, or heterocyclic group contained in such coupling-off groups may have one or more substituents, as described below.

Examples of coupling-off groups include a halogen atom (e.g., fluorine, chlorine, bromine), an alkoxy group (e.g., ethoxy, dodecyloxy, carboxypropyloxy), an aryloxy group (e.g., 4-chlorophenoxy group, a 4-methoxyphenoxy group), an acyloxy group (e.g., an acetoxy group, a tetradecanoyloxy group), an aliphatic or aromatic sulfonyloxy group (e.g., a methanesulfonyloxy group, a toluenesulfonyloxy group), an acylamino group (e.g., a dichloroacetylamino group, a trifluoroacetylamino group), an aliphatic or aromatic sulfonamido group (e.g., a methanesulfonamido group, a p-toluenesulfonamide group), an alkoxycarbonyloxy group (e.g., an ethoxycarbonyloxy group, a benzyloxycarbonyloxy group), an aryloxycarbonyloxy group (e.g., a phenoxycarbonyloxy group), an aliphatic, aromatic or heterocyclic thio group (e.g., an ethylthio group, a phenylthio group), a carbamoylamino group (e.g., an N-methylcarbamoylamino group, an N-phenylcarbamoylamino group), a 5-membered or 6-membered nitrogen-containing heterocyclic group (e.g., an imidazolyl group, a pyrazolyl group), an imido group (e.g., a succinimido group, a hydantoinyl group), an aromatic azo group (e.g., a phenylazo group), and the like.

The aliphatic, aromatic, or heterocyclic groups included in X and the groups shown by $R_1$ and $R_2$ may be substituted by a substituent such as, for example a halogen atom (e.g., a fluorine atom, a chlorine atom, a bromine atom, etc.), an alkyl group (e.g., a methyl group, a t-octyl group, a dodecyl group, a trifluoromethyl group, etc.), an alkenyl group (e.g., an allyl group, an octadecenyl group, etc.), an aryl group (e.g., a phenyl group, a p-tolyl group, a naphthyl group, etc.), an alkoxy group (e.g., a methoxy group, a benzyloxy group, a methoxyethoxy group, etc.), an aryloxy group (e.g., a phenoxy group, a 2,4-di-tert-amylphenoxy group, a 3-tert-butyl-4-hydroxyphenoxy group, etc.), an acyl group (e.g., an acetyl group, a benzoyl group, etc.), a sulfonyl group (e.g., a methanesulfonyl group, a toluenesulfonyl group, etc.), a carboxy group, a sulfo group, a cyano group, a hydroxy group, an amino group (e.g., a primary amino group, a dimethylamino group, etc.), a carbonamido group (e.g., an acetamido group, a trifluoroacetamido group, a tetradecanamido group, a benzamido group, etc.), a sulfonamido group (e.g., a methanesulfonamido group, a hexadecanesulfonamido group, a p-toluenesulfonamido group, etc.), an acyloxy group (e.g., an acetoxy group, etc.), a sulfonyloxy group (e.g., a methanesulfonyloxy group, etc.), an alkoxycarbonyl group (e.g., a dodecyloxycarbonyl group, etc.), an aryloxycarbonyl group (e.g., phenoxycarbonyl group, etc.), a carbamoyl group (e.g., a dimethylcarbamoyl group, a tetradecylcarbamoyl group, etc.), a sulfamoyl group (e.g., a methylsulfamoyl group, a hexadecylsulfamoyl group, etc.), an imido group (e.g., a succinimido group, a phthalimido group, an octadecenylsuccinimido group, etc.), a heterocyclic group (e.g., a 2-pyridyl group, a 2-furyl group, a 2-thienyl group, etc.), an alkylthio group (e.g., a methylthio group, etc.), and an arylthio group (e.g., a phenylthio group, etc.).

Also, examples of the coupler having the releasable group through a carbon atom for X include a so-called bis type coupler obtained by condensing a 4-equivalent coupler with an aldehyde or a ketone.

Any one of $R_1$, $R_2$ and X may be a divalent or a more polyvalent group to form an oligomer such as a dimer, etc., or may connect a polymeric main chain and a coupler skeleton to form a polymeric coupler, as shown below in formulas (III), (IV), and (V).

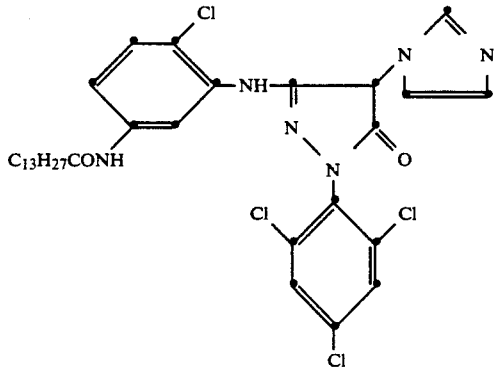

(II)-1

-continued
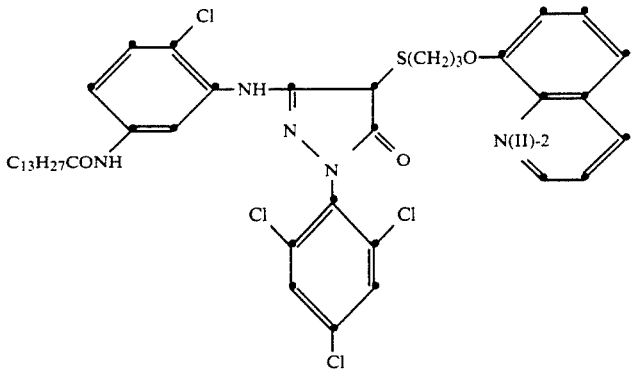
(II)-3
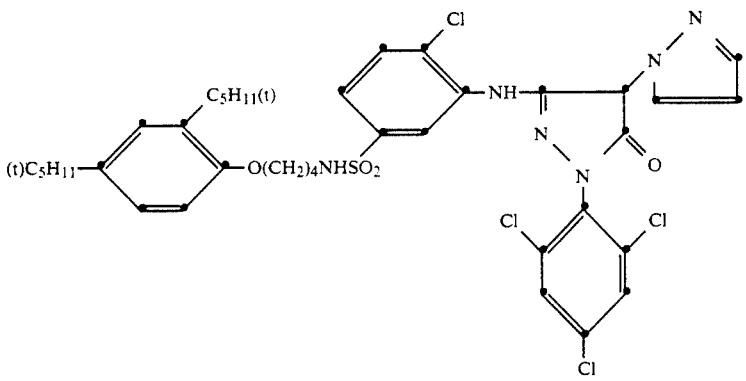
(II)-4
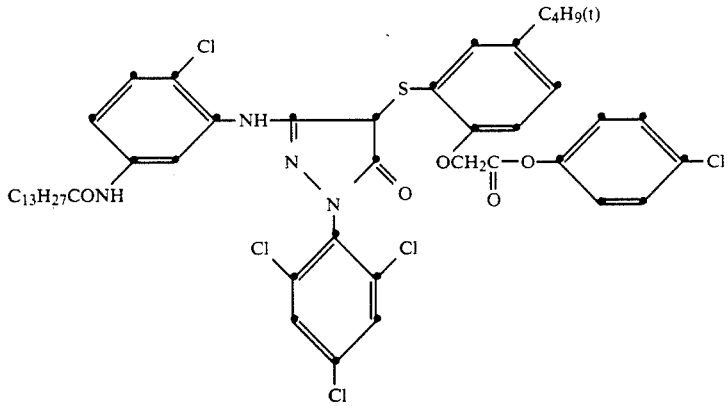
(II)-5
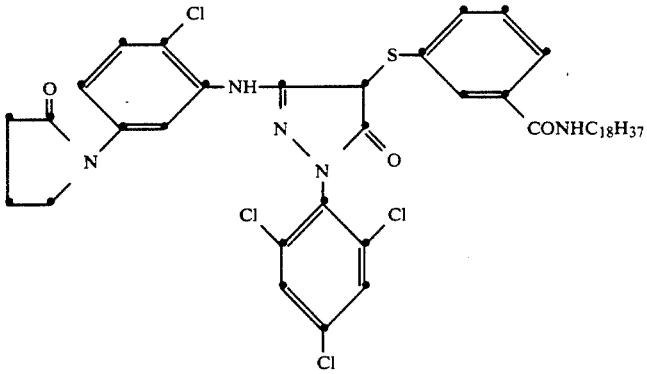

-continued
(II)-6
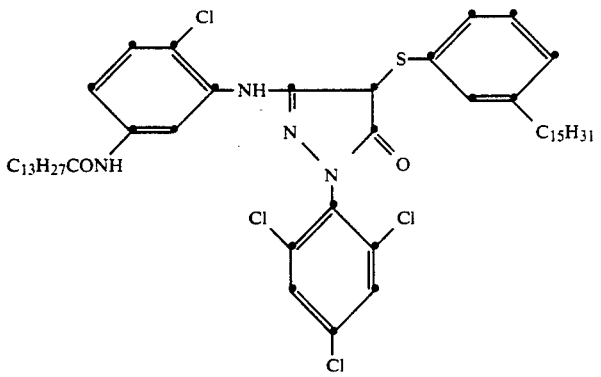
(II)-7
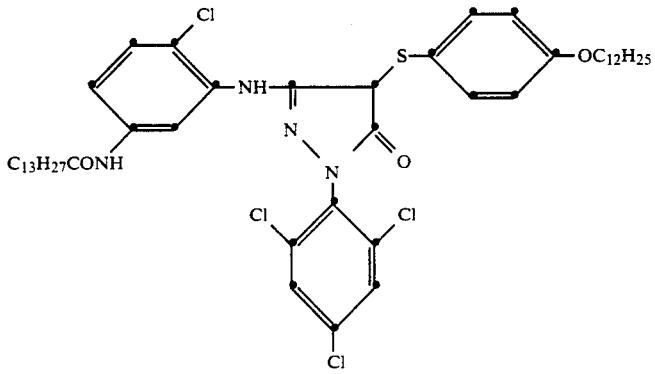
(II)-8
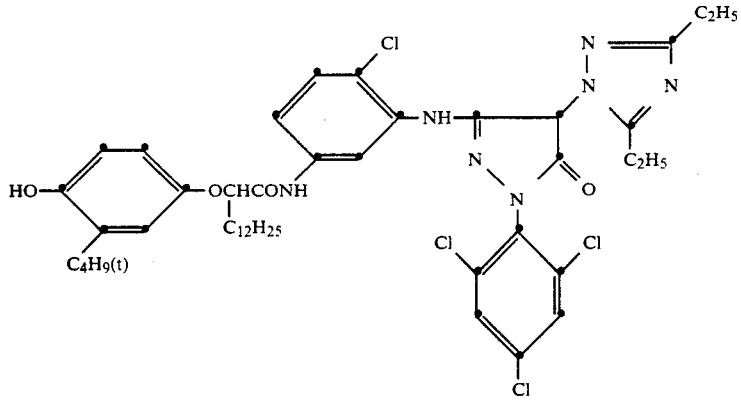
(II)-9
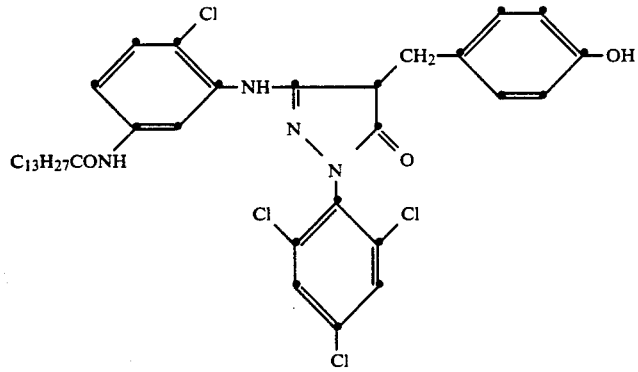
Polymeric 2-equivalent 5-pyrazolone couplers useful in the practice of the invention include those according to the formulas:

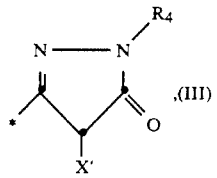

,(III)

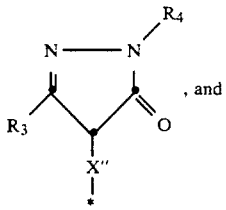

(IV)

, and

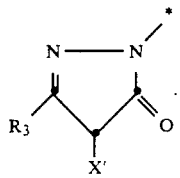

(V)

In these formulas, $R_4$ represents an alkyl group, a substituted alkyl group (e.g., haloalkyl such as fluoroalkyl, cyanoalkyl and benzylalkyl), or a substituted or unsubstituted aryl group. Examples of the substituent include an alkyl group (e.g., a methyl group and an ethyl group), an alkoxyl group (e.g., a methoxy group and an ethoxy group), an aryloxy group (e.g., a phenyloxy group), an alkoxycarbonyl group (e.g., a methoxycarbonyl group), an acylamino group (e.g., an aceylamino group), a carbamoyl group, an alkylcarbamoyl group (e.g., a methylcarbamoyl group and an ethylcarbamoyl group), a dialkylcarbamoyl group (e.g., a dimethylcarbamoyl group), an arylcarbamoyl group (e.g., a phenylcarbamoyl group), an alkylsulfonyl group (e.g., a methylsulfonyl group), an arylsulfonyl group (e.g., a phenylsulfonyl group), an alkylsulfonamido group (e.g., a methanesulfonamido group), an arylsulfonamido group (e.g., a phenylsulfonamido group), a sulfamoyl group, an alkylsulfamoyl group (e.g., an ethylsulfamoyl group), a dialkylsulfamoyl group (e.g., a dimethylsulfamoyl group), an alkylthio group (e.g., a methylthio group), an arylthio group (e.g., a phenylthio group), a cyano group, a nitro group, and a halogen atom (e.g., fluorine, chlorine and bromine); when the aryl group is substituted with two or more substituents, they may be the same or different.

When $R_4$ is an aryl group, preferred examples of the substituent are a halogen atom, an alkyl group, an alkoxyl group, an alkoxycarbonyl group, and a cyano group. A particularly preferred substituent is a halogen atom.

$R_3$ is a substituted or unsubstituted anilino group, a carbonamido group (e.g., an alkylcarbonamido group, a phenylcarbonamido group, an alkoxycarbonamido group and a phenyloxycarbonamido group), a ureido group (e.g., an alkylureido group and a phenylureido group), a sulfonamido group, an alkylamino group, a heterocyclic amino group, and preferably is a carbonamido group.

X' is a coupling-off group defined as above for X. Particularly preferred examples of the releasable group are nitrogen atom-containing releasable groups forming a heterocyclic ring such as an imidazolyl group and a pyrazolyl group.

X'' represents a divalent group, derived from X', having bonding sites to the pyrazolone ring and to $\text{-}(Y)_q\text{-}$ in the formulas (VI) and (VII).

In formulas (III), (IV) and (V), * indicates a site where the structure is linked to $\text{-}(Y)_q\text{-}$ in the formulas (VI) and (VII).

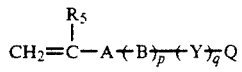

(VI)

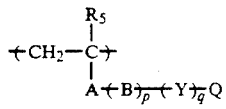

(VII)

In formula (VI) and (VII), $R_5$ represents a hydrogen atom, a lower alkyl group having from 1 to 4 carbon atoms, or a clorine atom, A represents —CONH—, —COO—, —O—, or a phenylene group, B represents an unsubstituted or substituted straight or branched alkylene group, aralkylene group, or phenylene group, Y represents —CONR'—, —NR'CONR'—, —NR'COO—, —NR'CO—, —OCONR'—, —NR'—, —COO—, —OCO—, —CO—, —O—, —$SO_2$—, —NR'$SO_2$— or —$SO_2$NR'—, wherein R' represents a hydrogen atom or substituted or unsubstituted aliphatic group or aryl group, and when two or more R's are present in one molecule, R's may be same or different.

q is 0 or 1, p is 0 when q is 0, or 1 when q is 1.

Q represents the 2-equivalent magenta coupler structure of formulas (III), (IV), and (V).

The polymer coupler of the present invention may be a homopolymer of a monomer coupler represented by formula (VI), or a copolymer of two or more of monomer couplers represented by formula (VI), or a copolymer of a monomer coupler of formula (VI) and one or more non-color-forming ethylenic monomer which does not couple with an oxidized product of an aromatic primary amine developing agent. Even in this case, as the monomer coupler of formula (VI), a copolymer comprising two or more of the monomer couplers represented by formula (VI) together with one or more of a non-color-forming ethylenical monomers may be used.

Of the above polymers, a copolymer of a monomer coupler of formula (VI) and a non-color-forming ethylenical monomer may be used.

The ethylenical monomer not forming color on coupling with an oxidized product of an aromatic primary amine developing agent includes acrylic acid, α-chloroacrylic acid, α-alkylacrylic acid (e.g., methacrylic acid), and their ester or amide derivatives (e.g., acrylamide, methacrylamide, n-butylacrylamide, tert-butylacrylamide, diacetoneacrylamide, methylenebisacrylamide, methyl methacrylate, ethyl acrylate, n-propyl acrylate, n-butyl acrylate, tert-butyl acrylate, iso-butyl acrylate, 2-ethylhexyl acrylate, n-octyl acrylate, lauryl acrylate, methyl methacrylate, ethyl methacrylate, n-butylmethacrylate, and β-hydroxyl methacrylate), vinyl esters (e.g., vinyl acetate, vinyl propionate and vinyl laurate), acrylonitrile, methacrylonitrile, aromatic vinyl compounds (e.g., styrene and its derivatives, such as vinyltoluene, divinylbenzene, vinylacetophenone and sulfonstyrene), itaconic acid, citraconic acid, crotonic acid, vinylidene chloride, vinyl alkyl ethers (e.g., vinyl ethyl ether), maleic acid esters, N-vinyl-2-pyrrolidone, N-vinylpyridine, and 2- and 4-vinylpyridine.

Particularly preferred examples are acrylic acid esters, methacrylic acid esters, and maleic acid esters. The above non-color forming ethylenically unsaturated monomers can be used as mixtures comprising two or more thereof. Typical examples are a combination of methyl acrylate and butyl acrylate, a combination of butyl acrylate and styrene, a combination of butyl methacrylate and methacrylic acid, and a combination of methyl acrylate and diacetone acrylamide.

As is well known in the polymer coupler field, the type of the ethylenicaly unsaturated monomer to be copolymerized with the monomer coupler of the general formula (V) can be chosen appropriately so as to exert favorable influences on the physical and/or chemical properties of the resulting copolymer, such as solubility, compatibility with a binder (e.g., gelatin) of a photographic colloid composition, flexibility, and heat stability.

The magenta polymer coupler as used herein can be conveniently handled in the form of a latex during the preparation of light-sensitive material. This latex can be prepared by two methods: one of the methods is such that an oleophilic polymer coupler as prepared by polymerization of the above monomer coupler is dissolved in an organic solvent and then dispersed or emulsified in an aqueous gelatin solution, and the other method is a direct emulsion polymerization method. The former method is described in U.S. Pat. No. 3,451,820, and the latter method is described in U.S. Pat. Nos. 4,080,211 and 3,370,952.

As a polymerization initiator and a polymerization solvent for use in the synthesis of the magenta polymer coupler of the present invention, compounds as described in Japanese patent applications (OPI) 81/5543, 82/94752, (U.S. Pat. No. 4,367,282) 82/176038 (U.S. Pat. No. 4,388,404), 82/204038 (U.S. Pat. No. 4,416,978), 83/28745 (U.S. Pat. No. 4,409,320), 83/10738, 83/42044, 83/145944 (U.S. Pat. No. 4,436,808), 83/224352 and 84/42543 (German Patent 2,127,984B) can be used.

The polymerization temperature is determined taking into consideration the molecular weight of the polymer formed, the type of the polymerization initiator, and so forth. The polymerization temperature can be between 0° and 100° C. Usually, the polymerization is carried out in range of from 30° to 100° C.

The proportion of the color forming portion of the monomer of formula (V) in the copolymer coupler is usually from 5 to 80 wt %. In view of color reproductivity, color forming properties and stability, the proportion is preferably from 20 to 70 wt %. In this case, the molecular weight equivalent (number of grams of the polymer containing 1 mol of the monomer coupler) is preferably from about 250 to 4,000 although it is not limited thereto.

Where groups above are described as substituted or unsubstituted, substituents for the groups can include, for example, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfonylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, an aryloxycarbonyl group, an alkenyl group, a carboxyl group, a sulfo group, a hydroxyl group, an amino group, and a carbonamido group, etc. $R_2$, $R_3$ and $R_4$ each preferably represents an alkyl group, an aryl group, a carbonamido group, a sulfonamido group or a ureido group.

Examples of polymeric 2-equivalent 5-pyrazolone couplers include:

C-1

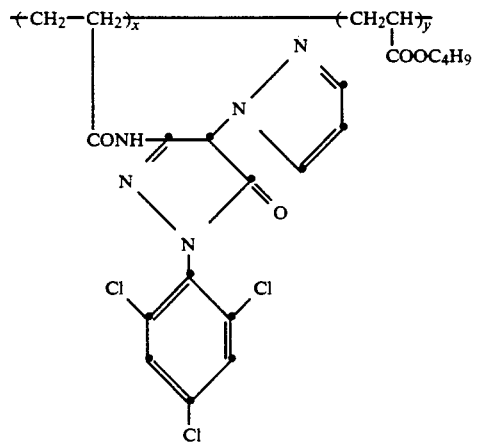

x/y = 50/50 (wt)

-continued

C-2

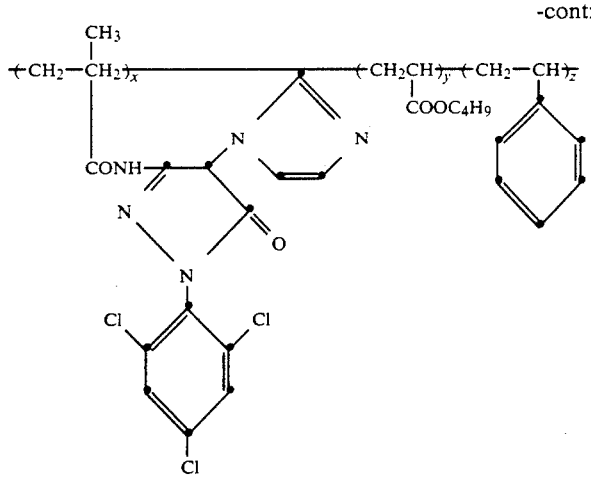

x/y/z = 50/25/25 (wt)

C-3

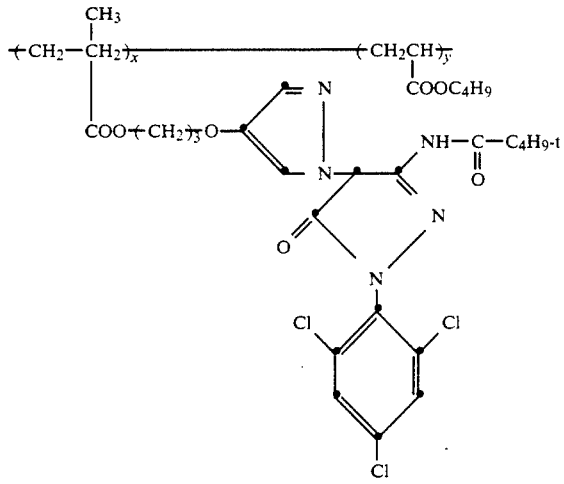

x/y = 70/30 (wt)

C-4

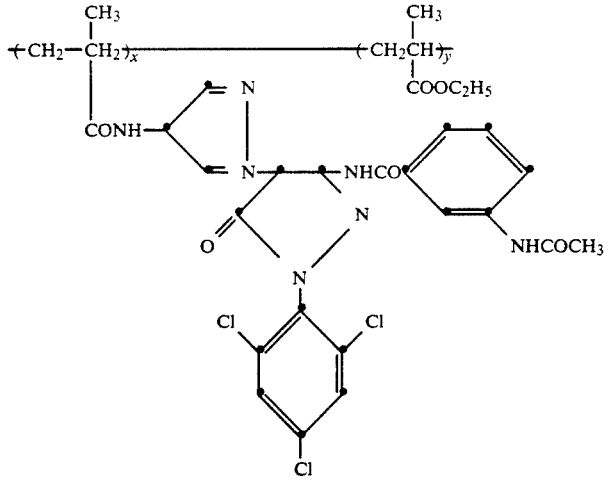

x/y = 50/50 (wt)

Other 2-equivalent 5-pyrazolone couplers useful in the practice of the invention are described in U.S. Pat. Nos. 4,791,051, 4,863,841, and 4,367,282, the disclosures of which is incorporated herein by reference.

The photographic element of the invention may be a negative or a reversal element. In a preferred embodiment of the invention, the photographic element is a color reversal material, such as those that are processable in Kodak E-6® processing (e.g., Kodak Ektachrome® products, Fuji Fujichrome® products). E-6® processing is described in *British Journal of Photography Annual,* 1977, pp. 194–197.

The support of the element of the invention can be any of a number of well-known supports for photographic elements. These include polymeric films such as cellulose esters (e.g., cellulose triacetate and diacetate)

and polyesters of dibasic aromatic carboxylic acids with divalent alcohols (e.g., poly(ethylene terephthalate)), paper, and polymer-coated paper. Such supports are described in further detail in *Research Disclosure*, December, 1989, Item 308119 [hereinafter referred to as *Research Disclosure I*], Section XVII.

The silver halide emulsion used in the practice of the invention can contain, for example, silver bromide, silver chloride, silver iodide, silver chlorobromide, silver chloroiodide, silver bromoiodide, or mixtures thereof. The emulsions can include coarse, medium, or fine silver halide grains bounded by 100, 111, or 110 crystal planes. Silver halide emulsions and their preparation are further described in *Research Disclosure I*, Section I. Also useful are tabular grain silver halide emulsions, as described in *Research Disclosure*, January, 1983, Item 22534 and U.S. Pat. No. 4,425,426.

The 2-equivalent 5-pyrazolone coupler (or mixtures of such couplers or mixtures with other magenta couplers) and the competitor of formula (I) (or mixtures of such competitors) used in the practice of the invention can be incorporated in hydrophilic layers of photographic materials by techniques well-known in the art. One common technique involves the use of high-boiling water-immiscible organic solvents and/or surfactants. Useful organic solvents include tricresyl phosphates, di-n-butyl phthalate, and others described in *Research Disclosure I*, Section XIV. Surfactants are well-known to one skilled in the art, and are described in *Research Disclosure I*, Section XI. Mixtures of solvents and surfactants may also be used.

The silver halide described above can be sensitized to a particular wavelength range of radiation, such as the red, blue, or green portions of the visible spectrum, or to other wavelength ranges, such as ultraviolet, infrared, and the like. In a preferred embodiment, the silver halide emulsion associated with the 2-equivalent 5-pyrazolone coupler is spectrally sensitized to green light so as to complement the magenta color of the dye formed by the coupler during processing. Chemical sensitization of silver halide can be accomplished with chemical sensitizers such as gold compounds, iridium compounds, or other group VIII metal compounds. Spectral sensitization is accomplished with spectral sensitizing dyes such as cyanine dyes, merocyanine dyes, styryls, or other known spectral sensitizers. Additional information on sensitization of silver halide is described in *Research Disclosure I*, Sections I–IV.

The photographic element of the invention may be a color element or monochromatic. Multicolor photographic elements according to the invention generally comprise a blue-sensitive silver halide layer having a yellow color-forming coupler associated therewith, a green-sensitive layer having a magenta color-forming coupler associated therewith, and a red-sensitive silver halide layer having a cyan color-forming coupler associated therewith. Color photographic elements and color-forming couplers are well-known in the art and are further described in *Research Disclosure I*, Section VII.

The element of the invention can also include any of a number of other well-known additives and layers, as described in *Research Disclosure I*. These include, for example, optical brighteners, antifoggants, oxidized developer scavengers (which can be the same as or different than the competitor according to formula (I)), development accelerators, image stabilizers, light-absorbing materials such as filter layers or intergrain absorbers, light-scattering materials, gelatin hardeners, coating aids and various surfactants, overcoat layers, interlayers and barrier layers, antistatic layers, plasticizers and lubricants, matting agents, development inhibitor-releasing couplers, bleach accelerator-releasing couplers, and other additives and layers known in the art.

The photographic elements of the invention, when exposed, are processed to yield an image. Processing can be by any type of known photographic processing, as described in *Research Disclosure I*, Sections XIX–XXIV. A negative image can be developed by color development with a chromogenic developing agent followed by bleaching and fixing. A positive image can be developed by first developing with a non-chromogenic developer, then uniformly fogging the element, and then developing with a chromogenic developer.

Bleaching and fixing can be performed with any of the materials known to be used for that purpose. Bleach baths generally comprise an aqueous solution of an oxidizing agent such as water soluble salts and complexes of iron (III) (e.g., potassium ferricyanide, ferric chloride, ammonium or potassium salts of ferric ethylenediaminetetraacetic acid), water-soluble persulfates (e.g., potassium, sodium, or ammonium persulfate), water-soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like.

The invention is further illustrated by the following Example:

EXAMPLE 1

Photographic elements were prepared by coating a cellulose triacetate film support with a photosensitive layer containing a silver bromoiodide emulsion at 0.83 g Ag/m$^2$, gelatin at 1.56 g/m$^2$, and one or two of the couplers identified below dispersed in one-half their total weight of tricresyl phosphate and coated at 1.13 mmoles/m$^2$. When the competitor was added to the coating, it was dispersed in an equivalent weight of di-n-butyl phthalate and was coated at 0.28 mmoles/m$^2$. The photosensitive layer was overcoated with a layer containing gelatin at 2.16 g/m$^2$ and bis-vinyl sulfonylmethyl ether at 1.5 weight percent based on total gelatin.

Samples of each element were imagewise exposed through a graduated-density test object and processed using standard Kodak® E-6 processing solutions and methods, using a shortened first development time of 4 minutes. The spectral dye density curves of the samples at a density near 1.0 were measured over a range from 400 nm to 700 nm, and the resulting data was normalized to a density of 1.0 at the peak wavelength (λ-max). From these curves, the spectral absorption at 430 nm was determined. The data is presented in Tables I and II below.

Comparative Coupler A
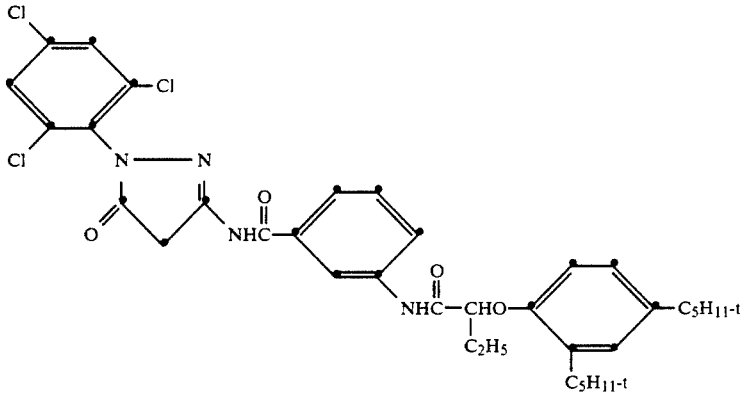
Comparative Coupler B
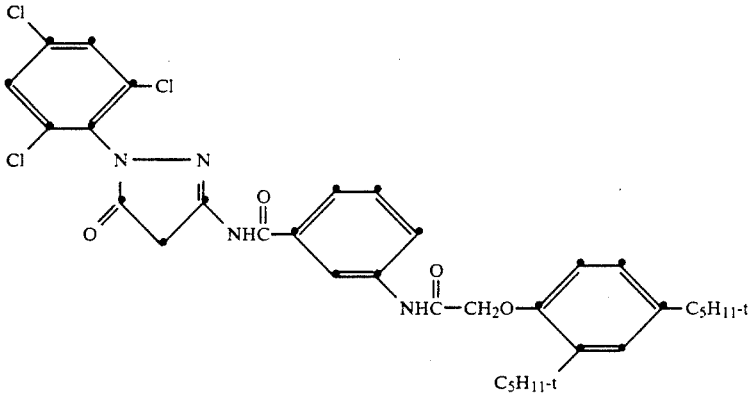
Inventive Coupler 1
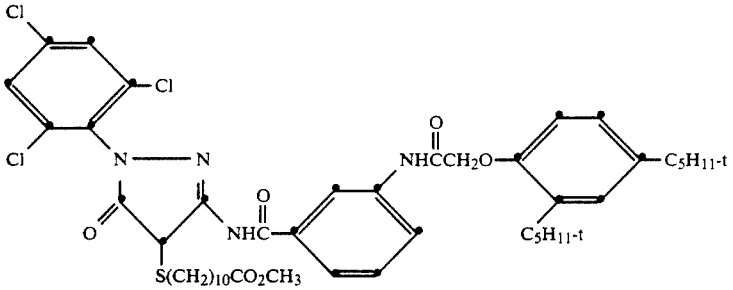
Inventive Coupler 2
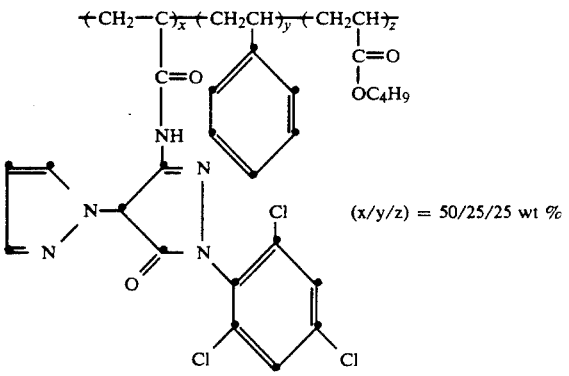
(x/y/z) = 50/25/25 wt %

-continued

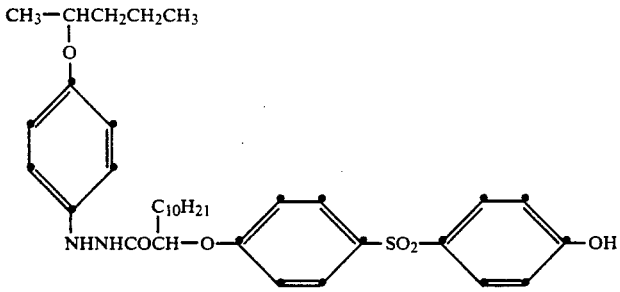

Inventive Competitor I

TABLE I

| Coupler | Competitor | Comparison or Invention | % D-Max Change for Use of Competitor Compared to No Competitor | Reversal D-Min | Spectral Absorption at 430 nm |
|---|---|---|---|---|---|
| 70% A/30% B | None | C | — | 0.05 | 0.15 |
| 70% A/30% B | I | C | −11 | 0.04 | 0.24 |
| 100% 1 | None | C | — | 0.09 | 0.16 |
| 100% 1 | I | I | +5 | 0.06 | 0.16 |

As can be seen in Table I, when the competitor is used with the comparison coupler, little reduction in reversal D-Min is achieved while a significant amount of D-max loss is observed and an undesirable increase in unwanted blue absorption is produced. When the competitor of the invention is used with the coupler of the invention, a larger reduction in D-min is achieved without D-max loss or blue absorption increase.

TABLE II

| Coupler | Competitor | Comparison or Invention | % D-Max Change for Use of Competitor Compared to No Competitor | γ at Dens = 0.6 | Spectral Absorption at 430 nm |
|---|---|---|---|---|---|
| B | None | C | — | −0.88 | 0.17 |
| B | I | C | −14.5 | −1.01 | 0.20 |
| 2 | None | C | — | −0.74 | 0.15 |
| 2 | I | I | +24.5 | −1.18 | 0.15 |

As can be seen in Table II, when the competitor is used in combination with the comparative coupler, desired increase in contrast (γ at Dens. = 0.6) is achieved, but is accompanied by a D-max decrease and an increase in unwanted blue absorption to the dye hue. When the inventive competitor is used in combination with the inventive coupler, a larger increase in contrast is attained while D-max is increased and no increase in unwanted blue absorption to the dye hue is observed.

The invention has been described in detail with particular reference to preferred embodiments thereof, but it will be understood that variations and modifications can be effected within the spirit and scope of the invention.

What is claimed is:

1. A color reversal photographic element comprising a support having thereon a silver halide emulsion layer, a 2-equivalent 5-pyrazolone coupler in reactive association with said silver halide emulsion, and a dispersion in a high boiling point water insoluble coupler solvent of a competitor for oxidized developer in reactive association with said coupler having the formula:

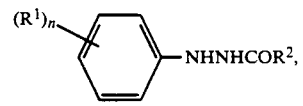

wherein $R^1$ represents an electron donating group, $R^2$ represents hydrogen, alkyl, alkoxy, aryl, aryloxy, aralkyl or amino of the formula —$NHR^3$, where $R^3$ is phenyl or benzyl, with the proviso that at least one of the substituents $R^1$ and $R^2$ (a) represents a ballast group of sufficient size as to render the hydrazide compound non-diffusible in the photographic element prior to development in alkaline processing solution and (b) comprises a polar group, and n is 0, 1 or 2.

2. A photographic element according to claim 1 wherein said coupler has the formula:

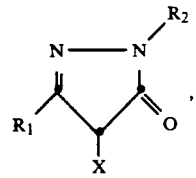

$R_1$ represents a carbonamido group, an arylamino group, a ureido group, a sulfonamido group, an alkylamino group, or a heterocyclic amino group, $R_2$ represents an aryl group, such as a substituted or unsubstituted aryl group, and X represents a group capable of being released by a coupling reaction with an oxidized aromatic primary amine developing agent.

3. A photographic element according to claim 1 wherein said coupler has the formula:

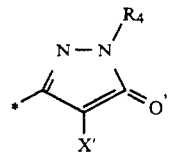

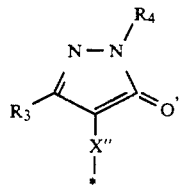

or

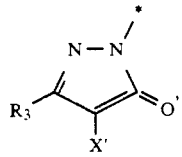

wherein $R^3$ represents a substituted or unsubstituted: arylamino group, a carbonamido group, a ureido group, a sulfonamido group, an alkylamino group, or a heterocyclic amino group, $R^4$ represents a substituted or unsubstituted: alkyl group or aryl group, X' represents a group capable of being released by a coupling reaction with an oxidized aromatic primary amine developing agent, X'' represents a divalent group derived from X' having bonding sites to the pyrazolone ring and to $-(Y)_q-$ in the formula hereinbelow,

* represents a site for linkage to $-(Y)_q-$ in the formula:

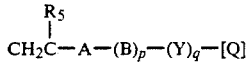

or

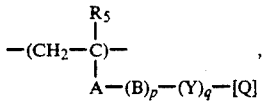

wherein $R_5$ represents a hydrogen atom, a lower alkyl group having from 1 to 4 carbon atoms, or a chlorine atom, A represents —CONH—, —COO—, —O—, or a phenylene group, B represents an unsubstituted or substituted straight or branched alkylene group, aralkylene group, or phenylene group, Y represents —CONR'—, —NR'CONR'—, —NR'—COO—, —NR'CO—, —OCONR'—, —NR'—, —COO—, —OCO—, —CO—, —O—, $—SO_2—$, $—NR'SO_2—$ or $—SO_2NR'—$, wherein R' represents a hydrogen atom or substituted or unsubstituted aliphatic group or aryl group, and when two or more R's are present in one molecule, R's may be same or different.

q is 0 or 1, p is 0 when q is 0, or 1 when a is 1.

4. A photographic element according to claim 3 wherein $R_3$ is an anilino group, a carbonamido group, or a ureido group.

5. A photographic element according to claim 2 wherein $R_1$ is an anilino group, a carbonamido group, or a ureido group.

6. A photographic element according to any of claim 1 wherein said polar group has a $\pi$ constant which is more negative than $-1.0$.

7. A photographic element according to claim 1 wherein $R^1$ is carbonamido of the formula $—NR^4COR^5$ where $R^4$ is hydrogen or alkyl of from 1 to about 8 carbon atoms and $R^5$ is as defined for $R^4$ or a benzyl or phenyl group.

8. A photographic element according to claim 1 wherein $R^1$ is sulfonamido of the formula $—NR^4SO_2R^5$ wherein $R^4$ is hydrogen or alkyl of from 1 to about 8 carbon atoms and $R^5$ is as defined for $R^4$ or a benzyl or phenyl group.

9. A photographic element according to claim 1 wherein $R^1$ is amino of the formula $—NR^4R^5$ wherein $R^4$ is hydrogen or alkyl of from 1 to about 8 carbon atoms and $R^5$ is as defined for $R^4$ or is benzyl or phenyl.

10. A photographic element according to claim 1 wherein $R^1$ is alkyl or alkoxy having from about 8 to about 16 carbon atoms.

11. A photographic element according to claim 1 wherein $R^2$ is aryl or aryloxy having from 6 to about 10 ring carbon atoms.

12. A color reversal processing method comprising the steps of developing an imagewise exposed photographic element with a non-chromogenic developer, then uniformly fogging the element, and then developing with a chromogenic developer, wherein said element comprises a support having thereon a silver halide emulsion layer a 2-equivalent 5-pyrazolone coupler in reactive association with said silver halide emulsion layer, and a competitor for oxidized developer in reactive association with said coupler having the formula:

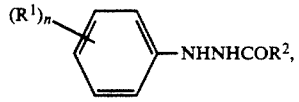

wherein $R^1$ represents an electron donating group, $R^2$ represents hydrogen, alkyl, alkoxy, aryl, aryloxy, aralkyl or amino of the formula $—NHR^3$, where $R^3$ is phenyl or benzyl, with the proviso that at least one of the substituents $R^1$ and $R^2$ (a) represents (1) a ballast group of sufficient size as to render the hydrazide compound non-diffusible in the photographic element prior to development in alkaline processing solution and (b) comprises a polar group, and n is 0, 1, or 2.

13. A photographic process according to claim 12 wherein said coupler has the formula:

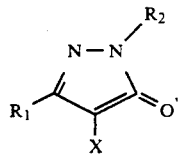

$R_1$ represents a carbonamido group, an arylamino group, a ureido group, a sulfonamido group, an alkylamino group, or a heterocyclic amino group, $R_2$ represents a substituted or unsubstituted aryl group, and X represents a group capable of being released by a coupling reaction with an oxidized aromatic primary amine developing agent.

14. A photographic process according to claim 12 wherein said coupler has the formula:

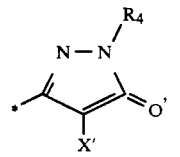

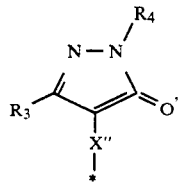

or

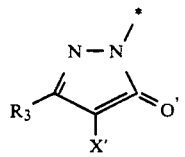

wherein $R_3$ represents a substituted or unsubstituted: arylamino group, carbonamido group, ureido group, sulfonamido group, alkylamino group, or heterocyclic amino group, $R_4$ represents a substituted or unsubstituted: alkyl group or aryl group, X' represents a group capable of being released by a coupling reaction with an oxidized aromatic primary amine developing agent, X'' represents a divalent group derived from X having bonding sites to the pyrazolone ring and to $-(Y)_q-$ in the formula below,

* represents a site for linkage to $-(Y)_q-$ in the formula:

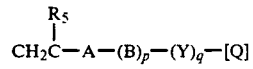

or

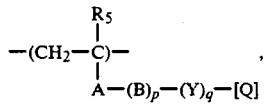

wherein $R_5$ represents a hydrogen atom, a lower alkyl group having from 1 to 4 carbon atoms, or a chlorine atom, A represents —CONH—, —COO—, —O—, or a phenylene group, B represents a substituted or unsubstituted straight or branched: alkylene group, aralkylene group, or phenylene group, Y represents —CONR'—, —NR'CONR'—, —NR'—COO—, —NR'CO—, —OCONR'—, —NR'—, —COO—, —OCO—, —CO—, —O—, —$SO_2$—, —NR'$SO_2$—, or —$SO_2$NR'—, wherein R' represents a hydrogen atom or a substituted or unsubstituted: aliphatic group or aryl group, and when two or more R's are present in one molecule, the R's may be the same or different, q is 0 or 1, and p is 0 when q is 0, or 1 when q is 1.

15. A photographic process according to claim 14 wherein $R_3$ is an anilino group, a carbonamido group, or a ureido group.

16. A photographic process according to claim 13 wherein $R_1$ is an anilino group, a carbonamido group, or a ureido group.

17. A photographic process according to claim 12 wherein said polar group has a $\pi$ constant which is more negative than $-1.0$.

18. A photographic process according to claim 12 wherein $R^1$ is carbonamido of the formula —$NR^4COR^5$ where $R^4$ is hydrogen or alkyl of from 1 to 8 carbon atoms and $R^5$ is as defined for $R^4$ or a benzyl or phenyl group.

19. A photographic process according to claim 12 wherein $R^1$ is sulfonamido of the formula —$NR^4SO^2R^5$ where $R^4$ is hydrogen or alkyl of from 1 to 8 carbon atoms and $R^5$ is as defined for $R^4$ or a benzyl or phenyl group.

20. A photographic process according to claim 12 wherein $R^1$ is amino of the formula —$NR^4R^5$ wherein $R^4$ is hydrogen or alkyl of from 1 to 8 carbon atoms and $R^5$ is as defined for $R^4$ or is benzyl or phenyl.

21. A photographic process according to claim 12 wherein $R^1$ is alkyl or alkoxy having from 8 to 16 carbon atoms.

22. A photographic process according to claims 12 wherein $R^2$ is aryl or aryloxy having from 6 to 10 ring carbon atoms.

* * * * *

UNITED STATES PATENT AND TRADEMARK OFFICE

CERTIFICATE OF CORRECTION

PATENT NO. : 5,147,764

DATED : September 15, 1992

INVENTOR(S) : Arlyce T. Bowne

It is certified that error appears in the above-indentified patent and that said Letters Patent is hereby corrected as shown below:

Abstract, line 13, "ofthe" should read --of the--.

Col 22, line 60, after "," insert --wherein--.

Col 24, line 14, after "to" delete --any of--.

Col 26, line 58, "claims" should read --claim--.

Signed and Sealed this

Eighth Day of February, 1994

Bruce Lehman

*Attest:*

BRUCE LEHMAN

*Attesting Officer*

*Commissioner of Patents and Trademarks*